US005396861A

United States Patent [19]

Acker et al.

[11] Patent Number: 5,396,861

[45] Date of Patent: Mar. 14, 1995

[54] BOAT COVERING SYSTEM

[75] Inventors: Stanley Acker; Stephen A. Heit, both of Nyack, N.Y.

[73] Assignee: Acker Investments, Inc., North Miami Beach, Fla.

[21] Appl. No.: 290,331

[22] Filed: Aug. 17, 1994

Related U.S. Application Data

[63] Continuation-in-part of Ser. No. 125,974, Sep. 23, 1993, abandoned.

[51] Int. Cl.[6] ..... B63B 17/00

[52] U.S. Cl. ..... 114/361; 135/119; 410/102

[58] Field of Search ..... 114/361; 135/119; 4/503; 410/102, 104, 106

[56] References Cited

U.S. PATENT DOCUMENTS

| | | | |
|---|---|---|---|
| Re. 26,363 | 3/1969 | Mills, II . | |
| 2,764,765 | 10/1956 | Woodruff, Sr. | 114/361 |
| 2,961,725 | 11/1960 | McGee | 114/361 |
| 3,910,330 | 10/1975 | Johnson et al. . | |
| 4,075,723 | 2/1978 | Bereis et al. . | |
| 4,094,021 | 6/1978 | Rapp | 4/503 |
| 4,292,913 | 10/1981 | Siebert et al. | 114/361 |
| 4,889,171 | 12/1989 | Minimo . | |

*Primary Examiner*—Jesus D. Sotelo
*Attorney, Agent, or Firm*—Baker & McKenzie

[57] ABSTRACT

An improved system for attaching boat covers to boats is provided. In the preferred embodiment, a male/-female connecting system is employed where one-half of the connecting system is attached to the cover via length-adjustable straps and the other half of the connecting system is attached to the boat via an attachment strip that provides for lateral movement of the connectors. Thus, one-half of the connecting system may be moved farther away or closer to the edge of the boat cover and the other half of the connecting system may be moved laterally along the boat side for easy connections. After all of the connections are made, the straps may be tightened to remove any slack from the boat cover and create a tight fit of the boat cover over the opening of the boat.

25 Claims, 3 Drawing Sheets

Fig. 1.
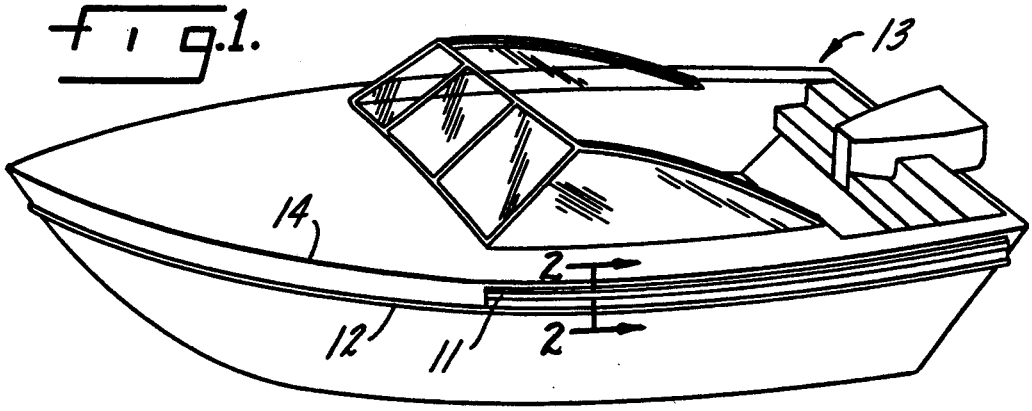
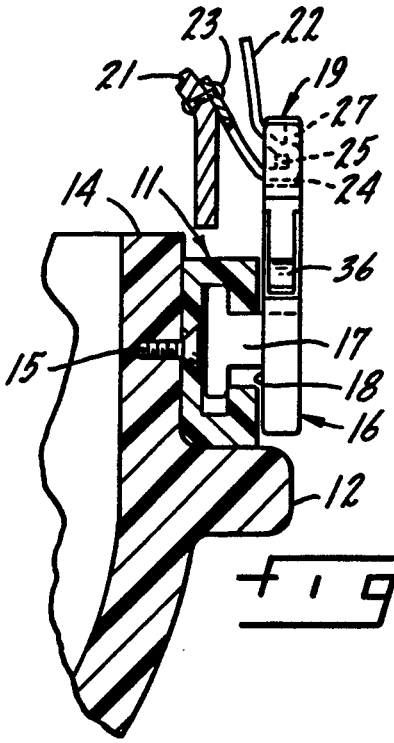
Fig. 2.
Fig. 3.
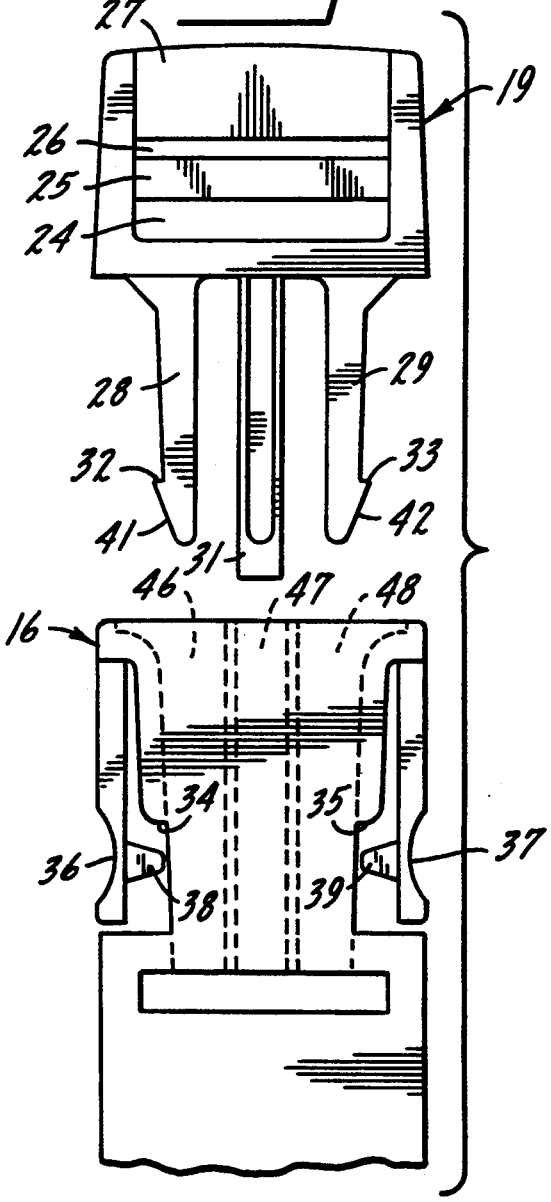
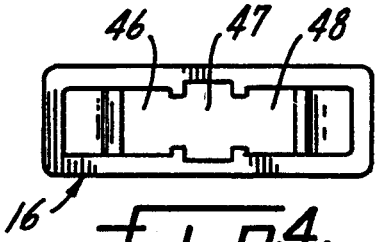
Fig. 4.

BOAT COVERING SYSTEM

This application is a continuation-in-part application of parent application serial No. 08/125,974, filed Sep. 23, 1998, now abandoned.

FIELD OF THE INVENTION

This invention relates generally to boat covers and more specifically to an improved method for attaching a boat cover to a boat. The invention provides an improved means for attaching a canvas or otherwise flexible boat cover over the opening of a boat.

BACKGROUND OF THE INVENTION

It is advantageous to cover the opening of a boat when a boat is not in use. When the boat is left at a dock, a cover over the opening reduces the amount of dirt that will accumulate in the opening and further protects the opening and any contents stored in the opening from weather, theft or vandalism. When a boat is towed by a motor vehicle, a cover over the opening will improve the wind resistance of the boat and also enables the boat owner to store articles in the opening during transport.

The boat covers currently available suffer from one primary defect. Specifically, the covers are very difficult to attach and remove. The most common means for attaching a flexible boat cover to a boat consists of metal snaps. The snaps are relatively small and are difficult to line up. During their useful life, canvas boat covers may shrink and therefore the user is forced to pull and stretch the used boat cover in order to line up the metal snaps for connection. Further, the metal snaps often break resulting in an additional frustration and cost to the boat owner.

Clearly, an improved means for attaching canvas or other flexible boat covers to boats is needed. The means for attaching the cover to the boat should be adjustable, i.e., the position of the connectors should be adjustable so that the boat owner does not need to physically stretch the boat cover in order to make a connection. Further, the system should preferably provide a means for tightening the cover once the attachment is made. It is important that a boat cover be tightly secured to a boat. For example, if the boat is to be towed at relatively high speeds on a highway, the boat cover needs to be tightly attached so it does not violently flap in the wind thereby causing undo wear and tear to the cover and damage to the boat. Further, a tightly secured boat cover is more likely to deter theft and vandalism than a loosely attached cover.

SUMMARY OF THE INVENTION

The present invention makes a significant contribution to the boat cover art by providing an improved means for attaching a flexible boat cover to a boat while the boat is not in use. The present invention provides an improved attachment system without requiring extensive design changes to new boats and further, without extensive modifications to existing boats.

The improved boat covering system includes a boat cover made of flexible sheet material. The material may be a canvas made from synthetic or natural fibers or a plastic sheet. Connectors are attached to at least two outer edges of the cover, the two outer edges corresponding to the port and starboard sides of the boat. Complimentary connectors are attached to the boat near the gunwale of the boat and preferably above the gunwale guards of the boat, if the boat is so equipped.

In one embodiment, the means for connecting the boat cover to the boat comprises a male/female connection system. The male connectors maybe attached to the cover or to the boat and the female connectors maybe attached either to the boat or to the cover. In one embodiment, the connectors that are attached to the cover are preferably attached to the cover via a strap which is fixedly attached to the cover at one end and adjustably connected to the connector at the other end. The adjustable connection between the strap and connector generally includes two parallel and transverse slots in the connector through which the strap can be passed. Slippage of the strap in the extension direction is prevented when the connector and strap are under stress and the loose end of the strap maybe pulled to tighten the cover after the connection is made.

The one preferred embodiment of attaching the corresponding connectors to the boat includes a C-shaped strip mounted to the gunwale portion of the side of the boat preferably above any gunwale guard provided on the side of the boat. The C-shaped strip may be mounted to the boat with screws, bolts, other fasteners, glue or adhesives. The corresponding connector to be mounted on the side of the boat includes a T-shaped extension which is accommodated within the C-shaped strip. The accommodation of the T-shaped extension in the C-shaped strip allows the connectors to be moved laterally or lengthwise along the side of the boat. This combination of lateral adjustment of the connectors mounted on the side of the boat and the lengthwise adjustment of the straps connecting the corresponding connectors to the cover enable to the user to make an easy connection and thereafter tighten the cover on over the opening of the boat with the adjustable straps. In one method of attaching the cover to the boat, all the connections are made and then the straps are tightened down later to securely and tightly fasten the cover to the boat.

Another system will include corresponding connectors simply mounted to the side of the boat with screws, bolts, other appropriate fasteners, glue or adhesive. Further, a T-shaped strip could be mounted to the boat and a C-shaped extension could be attached to the connectors to be slidably mounted onto the sides of the boat. Of course, male or female connectors may be attached to the cover and female or male connectors may be attached to the boat. Other connectors not properly falling under the male/female category may also be used with the present invention.

Still another embodiment of the present invention employs the use of VELCRO® straps. Specifically, a series of straps may be attached to T-shaped extensions that are disposed in the C-shaped strip mounted along the gunwale of the boat. Each end of the strap carries one-half of a VELCRO® connection. Each strap extends up through a hole disposed along the side of the cover and folds back onto itself to make a VELCRO® connection. Additionally, the VELCRO® straps may be sewn on to the edge of the cover and rings may be attached to the T-shaped extensions disposed in the C-shaped strips. The strap can feed down through the ring and fold back up onto itself thereby making the VELCRO® connection at the edge of the boat cover.

Yet another embodiment of the present invention employs the use of a buckle and adjustable strap system. One end of the buckle is attached to a strap that is sewn on to the buckle and includes a loop at its distal end. The loop may then accommodate a metal hook. A second strap is adjustably connected to the buckle and will also include a distal end with a loop that is preferably connected to a metal hook. One metal hook engages an eye or grommet in the boat cover and the other metal hook engages a ring or other similar connector connected to the gunwale of the boat.

It is therefore an object of the present invention to provide an improved boat covering system applicable to both recreational and commercial boats.

Yet another object of the present invention is to provide a boat cover that is easier and faster to attach and remove than the boat covers taught by the prior art.

Yet another object of the present invention is to provide an improved boat cover with an adjustable connecting mechanism.

BRIEF DESCRIPTION OF THE DRAWINGS

This invention is illustrated more or less diagrammatically in the accompanying drawings, wherein:

FIG. 1 is a perspective view of a boat equipped with a boat cover attachment mechanism made in accordance with the present invention;

FIG. 2 is a sectional view taken substantially along line 2—2 of FIG. 1;

FIG. 3 is an exploded view of a male/female connection mechanism made in accordance with the present invention;

FIG. 4 is an end view of the female component of the male/female connection system shown in FIG. 3;

Figure 5:
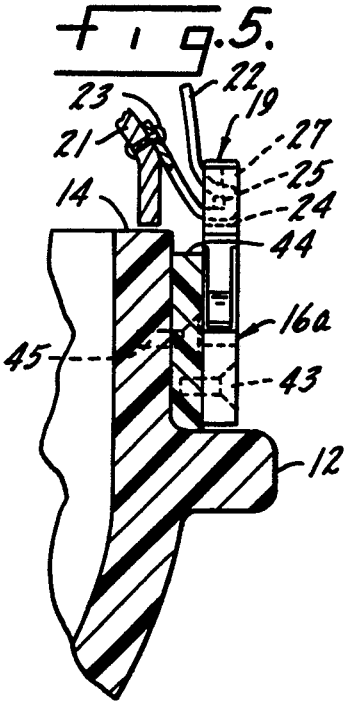
FIG. 5 is a sectional view of an alternative embodiment of a boat cover connection system made in accordance with the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE INVENTION

The dramatic improvement contributed by the present invention is best understood after consideration of how conventional boat covering systems work. Specifically, conventional boat covering systems are equipped with male and female metal snaps. Normally, the male metal snaps are attached to the side of the boat at or near the gunwale and the female metal snaps are connected to the cover. The user must then line up the relatively small female snaps over the male snaps and press inward. Because most boat covers are made of canvas fabricated from natural fibers, the boat covers have a tendency to shrink and stretch during extended use. When a boat cover shrinks, it is very difficult for the boat owner to line up all the snaps in order to make the appropriate connections to securely fasten the boat cover to the boat. Thus, a new, adjustable boat covering system is needed.

Turning to FIG. 1, the aforementioned need is satisfied by attaching the strip 11 just above the gunwale guard 12 of the boat 13. A strip identical to the one shown at 11 is also attached to the starboard side of the board (not shown). A better view of the strip 11 is provided in FIG. 2.

As seen in FIG. 2, the strip 11 is C-shaped. The strip 11 is attached to the gunwale portion 14 of the boat 13 above the gunwale guard 12 via a plurality of screws, one of which is shown at 15. As discussed above, the strip 11 may be attached with bolts, other fasteners, glue or adhesives or may be incorporated into the mold of the hull of the boat 13. In the embodiment shown in FIG. 2, the female connector 16 is attached to the strip 11 via the T-shaped extension 17 which extends rearward from the rear wall 18 of the female connector 16. The T-shaped extension 17 is accommodated within the C-shaped strip 11 which prevents the outward removal of the female connector 16 but allows for adjustment of the lateral position of the connector 16, i.e., the location of the female connector 16 along the side of the boat. Thus, the female connector 16 may be moved up and down the side of the boat 13 in order to be mated with a male connector 19 (see also FIG. 3).

In the embodiment shown in FIG. 2, the male connector 19 is attached to the flexible boat cover 21 via a strap 22. The strap 22 is fixedly attached to the cover 21 via an attachment means, indicated generally at 23 which maybe stitching, a staple, grommet or other fastener means. The strap 22 extends through a lower transverse slot 24 (see also FIG. 3) around the transverse bar 25 and through the upper transverse slot 26. Downward or outward pressure on the male connector 19 while the strap 22 is taut in an effort to extend the strap 22 to a longer configuration results in binding of the strap 22 against the transverse bar 25 and against the upper transverse bar 27 which precludes the lengthening of the strap 22. However, the strap 22 maybe pulled upward so that the male connector 19 is pulled closer to the cover 21.

Figure 6:
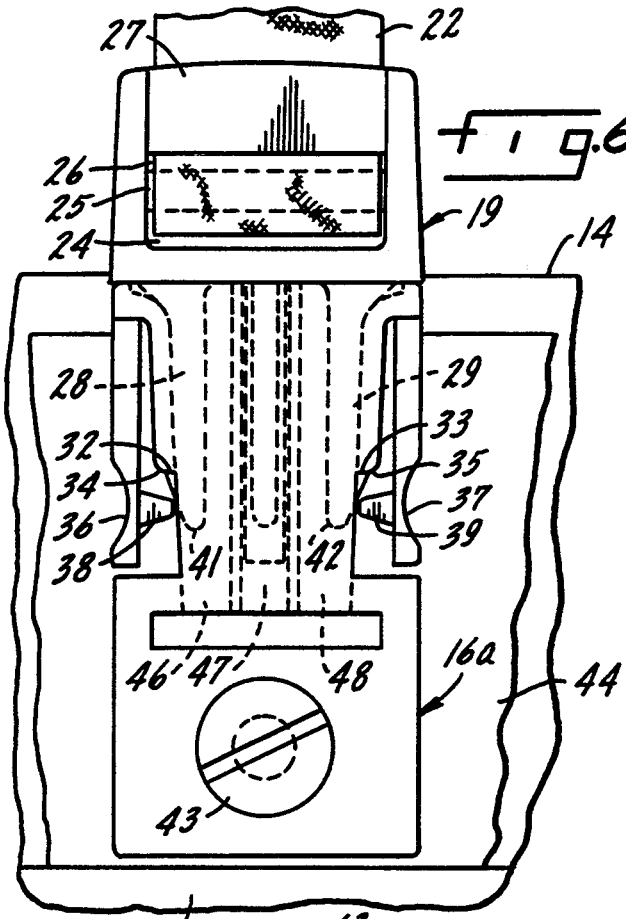
FIG. 6 is a partial front elevational view of the alternative connection system shown in FIG. 5.

Turning into FIG. 3, the male connector 19 includes two outer legs 28, 29 disposed on opposing sides of an inner guide member 31. To assume the locking position, the dogs 32, 33 engage the pawls 34, 35 of the female connector 16. An illustration of the locking position assumed by the male connector 19/female connector 16 is illustrated in FIG. 6. Returning to FIG. 3, to release the legs 28, 29 of the male connector 19 from the female connector 16, the user presses inward at the finger indentations 36, 37 which pushes the tabs 38, 39 inward against the ends 41, 42 of the legs 28, 29 which releases the dogs 32, 33 from the pawls 34, 35. It will be noted that the female connector 16 shown in FIG. 3 does not require a slot for accommodating the screw 43 as shown in FIG. 6. The female connector **16*a* shown in FIG. 6 is not received in a C-shaped slot 11 as seen in FIG. 2 but is mounted to a spacer strip 44 which is mounted to the gunwale 14**.

Turning to FIG. 4, an end view of the female connector 16 is provided particularly illustrating the passageways 46, 47, 48 for accommodating the leg 28, the guide member 31 and the leg 29, respectively. Reference can be made to U.S. Pat. Nos. 4,171,555 and 4,150,464 for additional discussion regarding the functional elements of connectors like those shown at 16, 19.

Turning to FIG. 5, a side view of the alternative embodiment is provided. The C-shaped strip 11 has been replaced by the spacer strip 44 which is mounted to the gunwale 14 via screws 45 or other attachment means, many of which are available and apparent to those skilled in the art. The female connector **16*a* is attached to the strip 44 via the screw indicated at 43 or other attachment means. The cooperating elements of the connector 16*a* and male connector 19 are identical to those described above with respect to FIGS. 2 through 4**.

As noted above, FIG. 6 is a front elevational view of the male connector 19 fully engaged in the female connector shown at **16*a*. If lateral movement of the female connector 16*a* is desired, then the spacer strip 44 should be replaced with the C-shaped strip illustrated at 11 in FIG. 2**.

Figure 7:
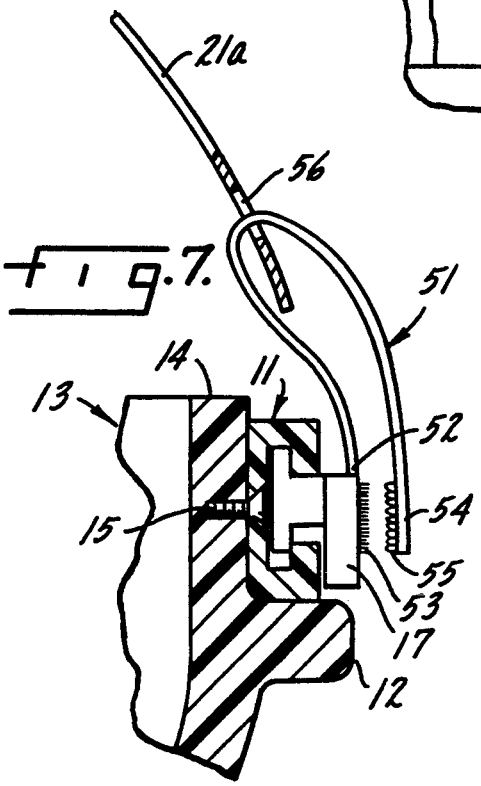
FIG. 7 is a sectional view of yet another alternative embodiment of a boat cover connection system made in accordance with the present invention.
Figure 8:
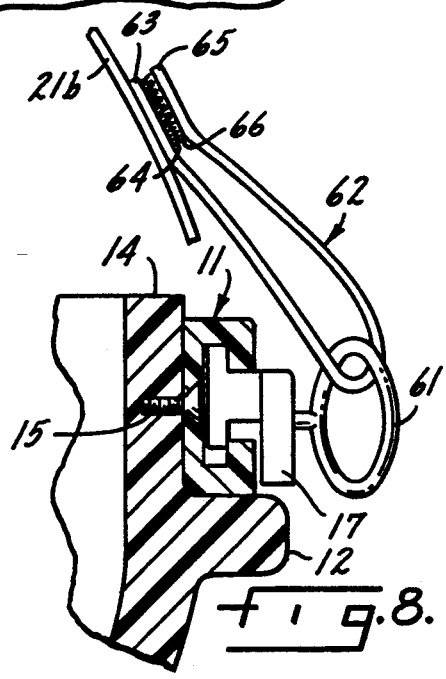
FIG. 8 is a sectional view of still another alternative embodiment of a boat cover connection system made in accordance with the present invention.

FIGS. 7 and 8 illustrate two additional alternative embodiments to the present invention. Specifically, FIG. 7 is an illustration employing an VELCRO® strap 51 attached to a T-shaped extension 17. A first end 52 of the strap 51 is equipped with one-half of a VELCRO® connection 53 and a second end 54 of the strap 51 is equipped with the other half of the VELCRO® connection 55. The strap 51 extends up through the hole 56 in the cover **21*a* and is folded back onto itself so the VELCRO® connections 53, 55 engage. A series of holes 56 are disposed at the outer edge of the cover 21*a* and the lateral adjustability provided by the T-shaped extension 17 C-shaped strip 11 combination make it very easy to secure the cover 21*a* to the boat 13**.

FIG. 8 is yet another alternative embodiment employing the C-shaped strip 11 and the T-shaped extension 17. Specifically, a ring 61 is attached to the T-shaped extension and a VELCRO® strap 62 is extended through the ring 61 and folded back on itself. A first end 63 of the strap 62 is sewn, stapled, or otherwise attached to the outer edge of the cover **21*b*. The first end 63 carries one-half of a VELCRO® connection 64 and the second end 65 of the strap 62 carries the other half of the VELCRO® connection 66**.

It will be noted that the embodiment shown in FIGS. 7, 8 may also be employed with the simpler attachment means shown in FIGS. 5 and 6 and discussed above. Further, if the straps 51, 62 are fabricated from an elastic material, the lateral adjustability afforded by the C-shaped strip 11/T-shaped extension 17 combination may not be required and the simpler attachment means shown in FIGS. 5 and 6 and discussed above may be sufficient.

Figure 9:
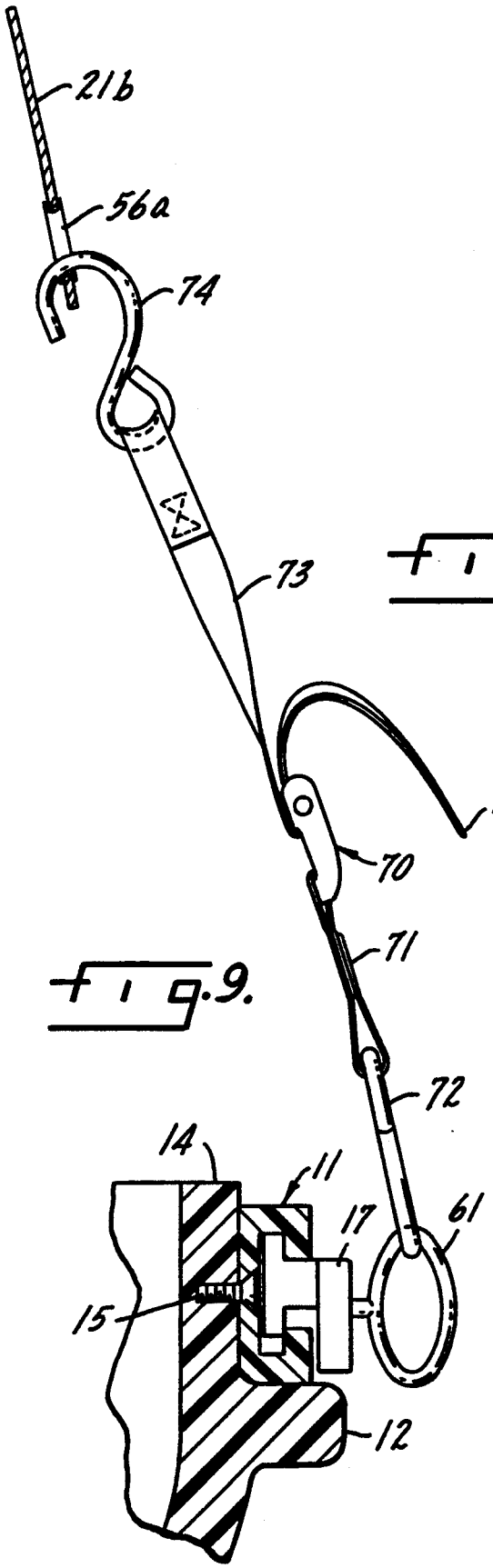
FIG. 9 is a sectional view of still another alternative embodiment of a boat cover connection system made in accordance with the present invention.
Figure 10:
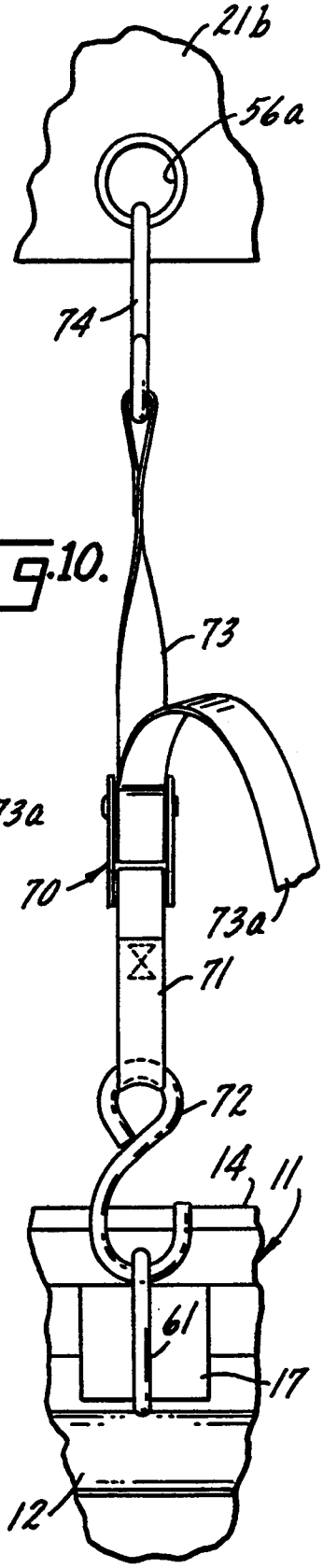
FIG. 10 is a partial front elevational view of the alternative connection system shown in FIG. 9.

FIGS. 9 and 10 illustrate yet another alternative embodiment employing an adjustable buckle 70. A first strap 71 is connected through one end of the buckle 70 and is also connected to a hook 72. The hook 72 engages a ring 61 similar to the one illustrated in FIG. 8. A second strap 73 is connected to a second hook 74 which engages a grommet 56a or other aperture disposed in the boat cover **21*b*. By pulling upward on the distal end 73*a* of the strap 73, the cover 21*b* is tightened. Of course, as noted above, the spacer strip 44 may be substituted for the c-shaped strip 11 and t-shaped extension 17 in designs where the ring 61 is attached directly to the spacer strip 44**.

Thus, a boat covering system is provided that allows the positions of the connectors to be adjusted in two ways. First, the length of the strap connecting the male or female connector to the boat cover maybe lengthened or shortened as needed which is important in tightening the cover once it is fully attached to the boat. Second, the lateral positions of either the male or female connector attached to the boat may be varied using the C-shaped strip 11 which greatly facilitates the attachment of the cover 21 to the boat 13. Boat owners no longer have to pull and tug in order to make the metal snaps lined up for engagement. Further, the length-adjustable strap that attaches a male or female component of the connecting system to the cover enables the cover to be tightened down for improved appearance, less flapping in the wind during towing operations and further to deter vandalism and theft of any contents kept in the opening of the boat during non-use.

While only five embodiments of the male/female connectors have been shown, other alternatives will be apparent those skilled in the art. Essentially, any male/-female connecting system would be appropriate. Further, the strap 22 may be varied to include flexible or elastic cords or even rubber or polymeric straps. The means for providing lateral movement of the connectors attached to the boat is not limited to the C-shaped strip shown in FIG. 2 but also include other embodiments. For example, a T-shaped holder could be mounted on the boat and rearwardly extending C-shaped extension could be mounted on the rear side of the female connector 16. The T-shaped or C-shaped strips may be an integrally molded feature of the hull like a gunwale guard. Of course, it will also be noted that the female connectors may be mounted to the flexible boat cover and the male connectors may be mounted to the boat. In contrast to the embodiment illustrated in FIGS. 5 and 6, the connector attached to the boat, either male or female, may be attached via VELCRO®, as opposed to screws or bolts. Further, glues, epoxies or other adhesives may be employed.

Although only five embodiments of the present invention have been illustrated and described, as noted above, it will at once be apparent to those skilled in the art that variations may be made within the spirit and scope of the invention. Accordingly, it is intended that the scope of the invention be limited solely by the scope of the hereafter appended claims and not by any specific wording in the foregoing description.

I claim:

1. A system for covering the opening of a boat when the boat is not in use, the system comprising:

a cover made from at least one sheet of flexible material, the cover including at least two outer edges including a port edge and a starboard edge, a plurality of male connectors fixedly attached to the outer edges of the cover, a plurality of female connectors for matable engagement with said male connectors, the female connectors slidably mounted near a gunwale of the boat at port and starboard sides thereof so that lateral positions of the female connectors may be adjusted to facilitate engagement with the male connectors, each of said male connectors connecting to a corresponding female connector thereby attaching the cover to at least the port and starboard sides of the boat, the boat further including gunwale guards disposed along the port and starboard sides of the boat, the female connectors being disposed above the gunwale guards.

2. The system of claim 1, wherein the male connectors are attached to the cover with an adjustable strap.

3. The system of claim 2, wherein each female connector includes a T-shaped extension, a C-shaped attachment strip being mounted to the port side of the boat and a C-shaped attachment strip being mounted to a starboard side of the boat, the T-shaped extensions of the female connectors being received in the C-shaped attachment strips for slidable connection of the female connectors to the port and starboard sides of the boat.

4. The system of claim 2, wherein each female connector includes a C-shaped extension, a T-shaped attachment strip being mounted to the port side of the boat and a T-shaped attachment strip being mounted to a starboard side of the boat, the C-shaped extensions of the female connectors being received around the T-shaped attachment strips for slidable connection of the female connectors to the port and starboard sides of the boat.

5. The system of claim 1, wherein the female connectors are attached to the gunwale of the boat with screws.

6. The system of claim 1, wherein a plurality of female connectors are mounted on the stern of the boat near the gunwale for matable connection with male connectors attached to the cover at an edge thereof corresponding to the stern of the boat.

7. A system for covering the opening of a boat when the boat is not in use, the system comprising:

a cover made from at least one sheet of flexible material, the cover including at least two outer edges including a port edge and a starboard edge, a plurality of female connectors fixedly attached to the outer edges of the cover, a plurality of male connectors for matable engagement with said male connectors, the male connectors mounted near a gunwale of the boat at port and starboard sides thereof, the male counterparts to said female connectors being slidably mounted near the gunwales of the boat so that lateral positions of the male connectors may be adjusted to facilitate engagement with the female connectors, each of said female connectors connecting to a corresponding male connector thereby attaching the cover to at least the port and starboard sides of the boat, the boat further includes gunwale guards disposed along the port and starboard sides of the boat, the male connectors being disposed above the gunwale guards.

8. The system of claim 7, wherein the female connectors are attached to the cover with an adjustable strap.

9. The system of claim 8, wherein each male connector includes a T-shaped extension, a C-shaped attachment strip being mounted to the port side of the boat and a C-shaped attachment strip being mounted to a starboard side of the boat, the T-shaped extensions of the male connectors being received in the C-shaped attachment strips for slidable connection of the male connectors to the port and starboard sides of the boat.

10. The system of claim 8, wherein each male connector includes a C-shaped extension, a T-shaped attachment strip being mounted to the port side of the boat and a T-shaped attachment strip being mounted to a starboard Side of the boat, the C-shaped extensions of the male connectors being received around the T-shaped attachment strips for slidable connection of the male connectors to the port and starboard sides of the boat.

11. The system of claim 7, wherein the male connectors are attached to the gunwale of the boat with screws.

12. The system of claim 7, wherein a plurality of male connectors are mounted on the stern of the boat near the gunwale for matable connection with female connectors attached to the cover at an edge thereof corresponding to the stern of the boat.

13. A system for covering the opening of a boat when the boat is not in use, the system comprising:

a cover made from at least one sheet of flexible material, the cover including at least two outer edges including a port edge and a starboard edge, a plurality of apertures disposed in the outer edges of the cover, a plurality of VELCRO ®-carrying straps mounted near a gunwale of the boat at port and starboard sides thereof, each strap being mounted to a T-shaped connection, a C-shaped attachment strip being mounted near the gunwale of the boat, the T-shaped extensions being received in the C-shaped attachment strips for slidable attachment of the straps to the boat, each strap having a first end and a second end, the first end of each strap being mounted to the gunwale of the boat, an outer surface of each first end carrying a first half of a VELCRO ® connection, the second end of each strap carrying a second half of a VELCRO ® connection, each strap extending through an aperture disposed in the cover and folding back to mate the first half of a VELCRO ® connection with the second half of a VELCRO ® connection thereby attaching the cover to at least the port and starboard sides of the boat.

14. The system of claim 13, wherein the straps are length-adjustable.

15. A system for covering the opening of a boat when the boat is not in use, the system comprising:

a cover made from at least one sheet of flexible material, the cover including at least two outer edges including a port edge and a starboard edge, a plurality of VELCRO ®-carrying straps fixedly attached to the outer edges of the cover, a plurality of ring means mounted near a gunwale of the boat at port and starboard sides thereof, each ring means being attached to a T-shaped extension, C-shaped attachment strips being attached to the boat near the gunwale, the T-shaped extension being received within the C-shaped extension for slidable attachment of the ring means to the boat, each strap having a first end and a second end, the first end of each strap being attached to the cover, an outer surface of each first end carrying a first half of a VELCRO® connection, the second end of each strap carrying a second half of a VELCRO® connection, each of said VELCRO®-carrying straps extending through a ring means and folding back to mate a first half of the VELCRO® connection with the second half of the VELCRO® connection thereby attaching the cover to at least the port and starboard sides of the boat.

16. The system of claim 15, wherein the strip is length-adjustable.

17. A system for covering the opening of a boat when the boat is not in use, the system comprising:

a cover made from at least one sheet of flexible material, the cover including at least two outer edges including a port edge and a starboard edge, a plurality of male connectors fixedly attached to the outer edges of the cover, a plurality of female connectors for matable engagement with said male connectors, the female connectors slidably mounted above a gunwale of the boat at port and starboard sides thereof so that lateral positions of the female connectors may be adjusted to facilitate engagement with the male connectors, each of said male connectors connecting to a corresponding female connector thereby attaching the cover to at least the port and starboard sides of the boat.

18. A system for covering the opening of a boat when the boat is not in use, the system comprising:

a cover made from at least one sheet of flexible material, the cover including at least two outer edges including a port edge and a starboard edge, a plurality of female connectors fixedly attached to the outer edges of the cover, a plurality of male connectors for matable engagement with said male connectors, the male connectors slidably mounted above a gunwale of the boat at port and starboard sides thereof so that lateral positions of the male connectors may be adjusted to facilitate engagement with the female connectors, each of said female connectors connecting to a corresponding male connector thereby attaching the cover to at least the port and starboard sides of the boat.

19. A system for covering the opening of a boat when the boat is not in use, the system comprising:

a cover made from at least one sheet of flexible material, the cover including at least two outer edges including a port edge and a starboard edge, a plurality of apertures disposed in the outer edges of the cover, a plurality of VELCRO®-carrying straps slidably mounted above a gunwale of the boat at port and starboard sides thereof so that lateral positions of the straps may be adjusted to facilitate engagement with the apertures disposed in the outer edges of the cover, each strap having a first end and a second end, the first end of each strap being slidably mounted to the gunwale of the boat, an outer surface of each first end carrying a first half of a VELCRO® connection, the second end of each strap carrying a second half of a VELCRO® connection, each strap extending through an aperture disposed in the cover and folding back to mate the first half of a VELCRO® connection with the second half of a VELCRO® connection thereby attaching the cover to at least the port and starboard sides of the boat.

20. A system for covering the opening of a boat when the boat is not in use, the system comprising:

a cover made from at least one sheet of flexible material, the cover including at least two outer edges including a port edge and a starboard edge, a plurality of VELCRO®-carrying straps fixedly attached to the outer edges of the cover, a plurality of ring means slidably mounted above a gunwale of the boat at port and starboard sides thereof so that lateral positions of the ring means may be adjusted to facilitate engagement with the straps attached to the outer edges of the cover, each strap having a first end and a second end, the first end of each strap being attached to the cover, an outer surface of each first end carrying a first half of a VELCRO® connection, the second end of each strap carrying a second half of a VELCRO® connection, each of said VELCRO®-carrying straps extending through a ring means and folding back to mate a first half of the VELCRO® connection with the second half of the VELCRO® connection thereby attaching the cover to at least the port and starboard sides of the boat.

21. A system for covering the opening of a boat when the boat is not in use, the system comprising:

a cover made from at least one sheet of flexible material, the cover including at least two outer edges including a port edge and a starboard edge, the outer edges of the cover including a plurality of apertures, a plurality of length-adjustable straps, each strap including a length-adjustable buckle for adjusting the length of the strap, a plurality of ring means mounted near a gunwale of the boat at port and starboard sides thereof, each ring means being attached to a T-shaped extension, C-shaped attachment strips being attached to the boat near the gunwale, the T-shaped extension being received within the C-shaped extension for slidable attachment of the ring means to the boat, each strap having a first end and a second end, the first end of each strap including a means engaging an aperture of the cover, the second end of each strap including means for engaging a ring means, each of said straps engaging one ring means and one aperture of the cover thereby attaching the cover to at least the port and starboard sides of the boat, the buckle of each strap providing means for tightening or loosening the cover on the boat.

22. The system of claim 21, wherein the means for engaging an aperture of the cover is a hook, the hook being fixedly attached to the first end of the strap.

23. The system of claim 21, wherein the means for engaging a ring means is a hook, the hook being fixedly attached to the first end of the strap.

24. A system for covering the opening of a boat when the boat is not in use, the system comprising:

a cover made from at least one sheet of flexible material, the cover including at least two outer edges including a port edge and a starboard edge, a plurality of male connectors detachably connected to the outer edges of the cover, a plurality of female connectors for matable engagement with said male connectors, the female connectors slidably mounted near a gunwale of the boat at port and starboard sides thereof so that lateral positions of the female connectors may be adjusted to facilitate engagement with the male connectors, each of said male connectors connecting to a corresponding female connector thereby attaching the cover to at least the port and starboard sides of the boat, the boat further including gunwale guards disposed along the port and starboard sides of the boat, the female connectors being disposed above the gunwale guards.

25. The system of claim 24, wherein each male connector includes at least one length-adjustable strap having a first end and a second end, the first end of each strap including means detachably connecting said male connector to the cover, the second end of each strap including means for engaging a female connector.

* * * * *